US007905330B2

(12) United States Patent
Jahkonen

(10) Patent No.: US 7,905,330 B2
(45) Date of Patent: Mar. 15, 2011

(54) DOOR CONTROL SAFETY ARRANGEMENT FOR TRANSPORTATION SYSTEM

(75) Inventor: Pekka Jahkonen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/551,373

(22) Filed: Aug. 31, 2009

(65) Prior Publication Data

US 2010/0051391 A1 Mar. 4, 2010

Related U.S. Application Data

(63) Continuation of application No. PCT/FI2008/000032, filed on Feb. 26, 2008.

(30) Foreign Application Priority Data

Mar. 1, 2007 (FI) ..... 20070177

(51) Int. Cl.
*B66B 1/34* (2006.01)

(52) U.S. Cl. ..... 187/391; 187/247; 187/316

(58) Field of Classification Search ..... 187/247, 187/293, 296, 297, 391–393, 316, 313, 317
See application file for complete search history.

(56) References Cited

U.S. PATENT DOCUMENTS

| | | | | | |
|---|---|---|---|---|---|
| 4,568,909 | A * | 2/1986 | Whynacht | 187/393 |
| 5,443,142 | A * | 8/1995 | Glaser | 187/316 |
| 5,487,448 | A * | 1/1996 | Schollkopf et al. | 187/247 |
| 5,549,179 | A * | 8/1996 | Herkel et al. | 187/298 |
| 5,610,374 | A * | 3/1997 | Boom et al. | 187/391 |
| 5,787,020 | A * | 7/1998 | Molliere et al. | 702/183 |
| 6,193,019 | B1 * | 2/2001 | Sirigu et al. | 187/391 |
| 6,591,947 | B2 * | 7/2003 | Horbrugger et al. | 187/393 |
| 7,350,624 | B2 * | 4/2008 | Deplazes et al. | 187/393 |
| 7,503,435 | B2 * | 3/2009 | Tyni et al. | 187/391 |
| 7,708,118 | B2 * | 5/2010 | Tyni et al. | 187/391 |

FOREIGN PATENT DOCUMENTS

| | | | |
|---|---|---|---|
| EP | 149727 | A1 * | 7/1985 |
| JP | 9-2764 | A | 1/1997 |
| WO | WO-2006/108433 | A1 | 10/2006 |

* cited by examiner

*Primary Examiner* — Jonathan Salata
(74) *Attorney, Agent, or Firm* — Birch, Stewart, Kolasch & Birch, LLP

(57) ABSTRACT

A system and a method for monitoring a safety circuit are presented. The system includes a control appliance and the safety circuit comprises at least one serial circuit of two or more switches. The arrangement system also includes a way of measuring the status of at least one switch, as well as a way of conveying the status information of the switch to the control appliance. The method includes measuring the status information of at least one switch and sending the measured status information to the control appliance.

19 Claims, 5 Drawing Sheets

DOOR CONTROL SAFETY ARRANGEMENT FOR TRANSPORTATION SYSTEM

Figure 1:
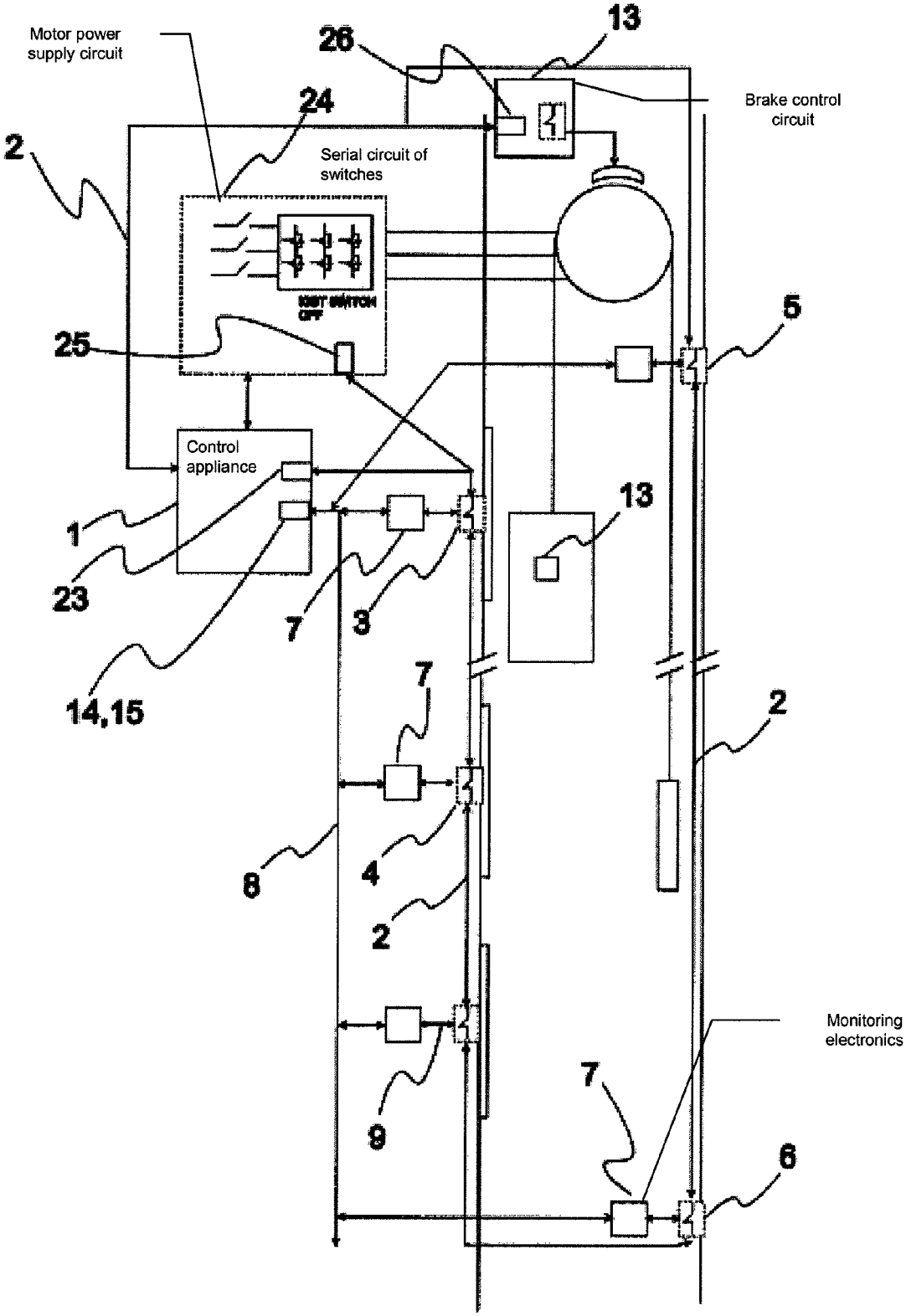

This application is a Continuation of copending PCT International Application No. PCT/FI2008/000032 filed in Finland on Feb. 26, 2008 which designated the United States, and on which priority is claimed under 35 U.S.C. §120. This application also claims priority under 35 U.S.C. §119(a) on Patent Application No. 20070177 filed in Finland on Mar. 1, 2007. The entire contents of each of the above documents is hereby incorporated by reference into the present specification.

FIELD OF THE INVENTION

An object of the invention is an arrangement for monitoring a safety circuit, in which the safety circuit comprises at least one serial circuit of two or more switches, and in which the arrangement comprises a control appliance, first means for measuring the status of at least one switch, as well as means, in connection with the first means, for conveying the status information of the switch to the control appliance. At least one serial connection of switches is fitted in connection with the brake control circuit and/or the power supply circuit of the motor. An object of the invention is also a method for monitoring a safety circuit, in which the safety circuit comprises a serial circuit of two or more switches, and in which method the status of at least one switch is measured with the first means; the status information of the switch is sent to the control appliance using the first means for conveying the status information of the switch to the control appliance; and at least one serial circuit of switches is fitted in connection with the brake control circuit and/or the power supply circuit of the motor.

BACKGROUND OF THE INVENTION

In elevator systems and escalator systems, movement of the transport appliance is permitted only when the preconditions required to ensure the safety of passengers are fulfilled. For example, in elevator systems movement of the elevator car is permitted only when the doors of the elevator car and of the shaft are closed. In elevator systems and escalator systems safety is typically ensured with a safety circuit. The safety circuit can be implemented e.g. such that switches, which are connected to each other in series, are placed in the points that are essential from the standpoint of safety. The electricity supply of the motor of the transport appliance and in an elevator system the opening of the holding brakes are only permitted if all the switches of the safety circuit are closed.

Normally at least the coil of the main contactor and the coil of the machinery brake of the motor are in the same circuit with the switches. The circuit of the switches is arranged to open in a dangerous situation, in which case the main contactors open and the machinery brake energizes. The status of the safety circuit can also be monitored with the control system, e.g. by measuring the voltage across the circuit of the switches according to prior art.

In order to locate a dangerous situation, the status of individual switches in the elevator system or escalator system must be measured. For this purpose at least some of the switches of the safety circuit are conventionally wired separately to the control system for measuring the statuses of individual switches. The control system can be disposed in the machine room or e.g. on the landing floor of the elevator, and the switches can be situated at a distance from the control system, such as in the elevator shaft or in the elevator car. In this case wiring individual switches to the control system substantially increases the amount of wiring.

If individual switches are not monitored and their operation is not supervised either, there must otherwise be safeguards for the safe operation of the circuit formed by the switches. In this case the switch must be constructed as a duplicated switch that opens under forced control. This kind of switch of special construction is expensive.

Prior art technology is represented in publication elevator US-20040173410, which contains an arrangement for monitoring the door switches of an elevator system. Each door switch is monitored separately and the status data of the switches is transmitted to a serial interface bus. For adequate reliability to be achieved with this kind of solution, the measurements of the switches as well as the serial interface bus and the electronics participating in the serial interface communication must be duplicated. This increases the costs of the overall system. In addition, if it is desired to connect different actuators to the same system, also the controls of these actuators as well as their monitoring must be duplicated in order to achieve adequate reliability.

Publication JP 9-2764 A presents an arrangement for monitoring the safety circuit of an elevator. The arrangement comprises a control appliance, and the safety circuit comprises as serial circuit of switches. The arrangement comprises means for measuring the status of at least one switch, as well as means for conveying the status information of the switch to the control appliance.

Purpose of the Invention

The purpose of this invention is to disclose an arrangement and a method for monitoring individual safety circuit switches. The purpose of the arrangement and the method is to improve the dependability and operating reliability of the whole system.

Advantages of the Invention

With the invention at least one of the following advantages, among others, is achieved:

- When the operation of the switches is monitored with two independent measurements, it is possible to achieve adequate operating reliability with switches that are simple in structure.
- If the monitoring electronics of a switch is disposed in a T-connector separate from the switch, the switch itself is small in size and it is easy to place e.g. in the landing door of the elevator.
- If the status data of the switches are sent to the control appliance as serial interface signals, individual switches do not need to be separately wired to the control appliance for monitoring purposes, in which case the wiring of the overall system is simplified.
- The data transfer channel used for monitoring the switches can also be used for transmitting different control commands of the elevator system, such as the control commands of actuators, as well as for transmitting monitoring and measuring information. Thus the wiring of the system is reduced and simplified.
- If the monitoring electronics of a switch is not integrated in a fixed manner into the switch, the switch can be changed without the need to change the monitoring electronics. Since a switch is a mechanical, wearing part, this reduces servicing costs.

The control system can send to the servicing center an itemized defect notification specifying in which part of the safety circuit the defect is located.

When the monitoring electronics of a switch is disposed inside a T-connector, in the manner proposed in the invention, it can be made moisture-proof and thus the reliability of the electrification of the elevator is improved.

When the switches are arranged into a serial connection circuit, the status of serial connection circuit can be measured with the control system. When, in addition to this, the status of individual switches is measured and the status information is conveyed to the control system along the data transfer channel, duplicated measurement of the status of a switch is achieved. In this case a normal, single-channel unduplicated serial interface bus can be used as a data transfer channel while still achieving an adequate level of reliability.

SUMMARY OF THE INVENTION

The arrangement of the invention for monitoring a safety circuit is characterized by fitting at least one serial connection of switches in connection with the brake control circuit and/or the power supply circuit of the motor. The method according to the invention for monitoring a safety circuit is characterized by fitting at least one serial circuit of switches in connection with the brake control circuit and/or the power supply circuit of the motor.

Other embodiments of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

In the arrangement according to the invention for monitoring a safety circuit the safety circuit comprises at least one serial circuit of two or more switches. The arrangement also comprises a control appliance, first means for measuring the status of at least one switch, as well as means, in connection with the first means, for conveying the status information of the switch to the control appliance.

In one arrangement according to the invention at least one serial circuit of switches is fitted in connection with the brake control circuit and/or the power input circuit of the motor. In this case the brake and/or the power supply of the motor can be controlled on the basis of the status of the switch.

In one arrangement according to the invention at least one serial circuit of switches is in the brake control circuit and/or in the power supply circuit of the motor.

In the arrangement according to the invention safety circuit means two or more switches, which are connected in series for monitoring the safety of a transport system. The switches can be safety switches disposed in points in the system that are important from the standpoint of safety. These kinds of points are e.g. the landing doors of an elevator system, in which the switches can be disposed for monitoring the position of the door. Other important points in an elevator system from the standpoint of safety are e.g. the ends of the elevator shaft. Final limit switches can be disposed in these, which open when the elevator car moves to the switch. On the basis of the opening of the switches, further movement of the elevator car closer to the ends is prevented e.g. by controlling a prior-art stopping appliance of the elevator system.

One arrangement according to the invention comprises second means for measuring the status of the serial circuit of switches.

In one arrangement according to the invention first means are fitted in connection with a switch for measuring the voltage between the contacts of the switch.

In one arrangement according to the invention first means for measuring the current traveling in a switch are fitted in connection with the switch.

In one arrangement according to the invention second means for measuring the status of the serial circuit of switches are in the control appliance.

In one arrangement according to the invention the means for conveying the status information of a switch to the control appliance comprises a transmitter in connection with the switch, a receiver in connection with the control appliance, and a data transfer channel between the transmitter and the receiver.

One arrangement according to the invention comprises a T-connector. In this case the first means for measuring the status of a switch as well as the transmitter are fitted inside the T-connector.

In one arrangement according to the invention the safety circuit contains at least one actuator, and a transmitter is in connection with the actuator.

In one arrangement according to the invention a receiver, which is connected to a data transfer channel, is in connection with the actuator.

In one arrangement according to the invention a transmitter is fitted to send status information to the control appliance preferably as a serial interface message.

In one arrangement according to the invention the control appliance contains a receiver.

In the method according to the invention for monitoring a safety circuit the safety circuit comprises a serial circuit of two or more switches. In the method the status of at least one switch is measured with the first means, and the status information of the switch is sent to the control appliance using the first means for conveying the status information of the switch to the control appliance.

In one method according to the invention at least one serial circuit of switches is fitted in connection with the brake control circuit and/or with the power input circuit of the motor.

In one method according to the invention the status of at least one serial circuit of switches is measured with the second means for measuring the status of the serial circuit of switches.

One arrangement according to the invention comprises a data transfer channel, a T-connector, a detector of the status of a switch, and a transmitter. One method according to the invention in this case comprises the phases: means for measuring the status of at least one switch are fitted in connection with the switch; a transmitter is fitted in connection with the means; the means for measuring the status of at least one switch as well as a transmitter are fitted inside a T-connector; and the transmitter is connected to a data transfer channel such that the connection between the transmitter and the data transfer channel remain inside the T-connector.

The arrangement and the method according to the invention relate generally to safety circuits of various transport systems, such as an elevator system, an escalator system, a travelator, or a crane system or a drum drive elevator system.

On the basis of the status of the safety switch it is possible to control e.g. the machinery brake or a stopping appliance that grips the guide rail of the elevator car and thus prevent a situation that poses danger to the passengers of the elevator car. The serial circuit of switches can be a part of the control current circuit of a stopping appliance, in which case the current supply of the circuit disconnects when the switch opens, and the stopping appliance operates. On the basis of the status of the safety switches it is also possible to disconnect the power supply circuit of the elevator motor. Power supply circuit means a power input circuit formed of possible main contactors and the frequency converter of an elevator motor, the disconnection of which prevents power flowing from the power sources to the elevator motor. Disconnection can be effected e.g. by opening the main contactor or by preventing the connection of the switches of the frequency converter. The serial circuit of switches can be a part of the power supply circuit, in which case the opening of a switch disconnects the power supply circuit. On the basis of the status of the switches it is possible on the other hand to also control the elevator motor with the frequency converter such that the elevator car is stopped in a controlled way at the nearest exit floor under the control of the frequency converter. In this case the power supply circuit and the brake control circuit are not necessarily opened.

The arrangement according to the invention can comprise one serial connection circuit, in which all the switches are connected in series. The arrangement can also comprise a number of different serial connection circuits, each of which contains two or more switches.

In the arrangement according to the invention the status of the safety circuit can be measured by measuring separately the status of at least one serial connection circuit as well as the status of the separate switches of the serial connection circuit. The arrangement according to the invention comprises at least first means for measuring the status of at least one separate switch. In addition, the arrangement according to the invention can comprise second means for measuring the status of the serial circuit of switches.

The status of an individual switch can be measured with the first means e.g. by measuring the voltage between the contacts of the switches with some kind of prior-art voltage measurement method. This kind of method can be e.g. a resistor disposed in parallel with the switch and a serial circuit of an opto-isolator, in which case as the voltage over the switch grows on the primary side of the opto-isolator, and thus also on the secondary side, current begins to flow. In this kind of measuring system voltage must be supplied to the serial circuit of switches with some kind of prior-art AC or DC voltage source. When at least one of the switches of the serial connection circuit opens, it is possible to measure the voltage difference over the contacts of the switch.

Another method of measuring the status of an individual switch with the first means is measuring the current traveling through the switch. The current can be measured with some kind of prior-art current measuring appliance, such as with a Hall sensor or with a series resistor. When at least one of the switches of the serial connection circuit opens, the flow of current through the switch ceases. If in this case it is desired to specify the switch that opened, a parallel connection resistor must be in parallel with at least the opened switch, so that the passage of current through the other switches of the serial connection circuit does not disconnect and so that the closed switches can be identified on the basis of the passage of current.

In one preferred embodiment of the invention at least one serial connection circuit is disposed as a part of the power supply circuit of the motor. In this case the opening of the serial connection circuit disconnects the power supply circuit and the power supply to the elevator motor is cut.

In one embodiment of the invention a transmitter is in connection with the switch and the control appliance contains a receiver. The status information of the switch is transmitted with the transmitter to the data transfer channel and is received by the control appliance from the data transfer channel with the receiver. The status information can be conveyed e.g. with some prior-art serial interface signal, such as with a SPI, UART or DTMF signal. The status information can also be conveyed as e.g. an analog signal.

In one embodiment of the invention means for detecting the status of a switch as well as a transmitter are disposed inside a special T-connector. A T-connector means a connector, from which the conductor branches in three different directions. The connector in question can be used e.g. to connect a new wiring branch in connection with a main branch. The new wiring branch can be e.g. a measuring wire of a switch, and the main branch can be a data transfer channel.

Separate actuators can also be connected to the safety circuit according to the invention. On such actuator can be a stopping appliance, such as a guide rail brake, that grips the guide rail of the elevator car. The guide rail brake can be connected to the safety circuit e.g. such that at least one serial connection of switches is in the magnetizing circuit of the guide rail brake. When a switch opens the magnetizing current supply of the guide rail brake disconnects and the guide rail brake connects mechanically to the guide rail of the elevator car.

A receiver, which is connected to the data transfer channel, can be in connection with the actuator. Correspondingly, a transmitter can be in connection with the control appliance of the elevator system. A control appliance means here an appliance generally needed to control an elevator system, comprising all the higher level control systems, such as the control systems of the elevator system, of the elevator car and of the elevator motor as well as e.g. systems related to fault diagnostics. In one embodiment of the invention the control appliance sends actuator control signals to the data transfer channel with the transmitter, such as controls of the guide rail brake, and the actuator, e.g. the guide rail brake, receives control signals from the data transfer channel with its receiver. The guide rail brake connects to the guide rail according to the control signals. A transmitter can also be in connection with the actuator, with which the actuator sends information about its operating status to the control appliance. The control appliance can send a control command to the actuator and read the signal sent by the actuator after this, and thus monitor the operating condition of the actuator. The control electronics of the transmitter, the receiver and possibly of the actuator can be disposed inside the T-connector. The control electronics of the actuator means the control logic, means for measuring the status of the actuator and a possible amplifier circuit, with which the control signal of the actuator is amplified, e.g. for controlling the current of the magnetic circuit of the guide rail brake. The control signals can travel in the data transfer channel as prior-art serial interface signals.

The transmitter and the receiver can be integrated into the same microcircuit.

LIST OF FIGURES

Figure 2:
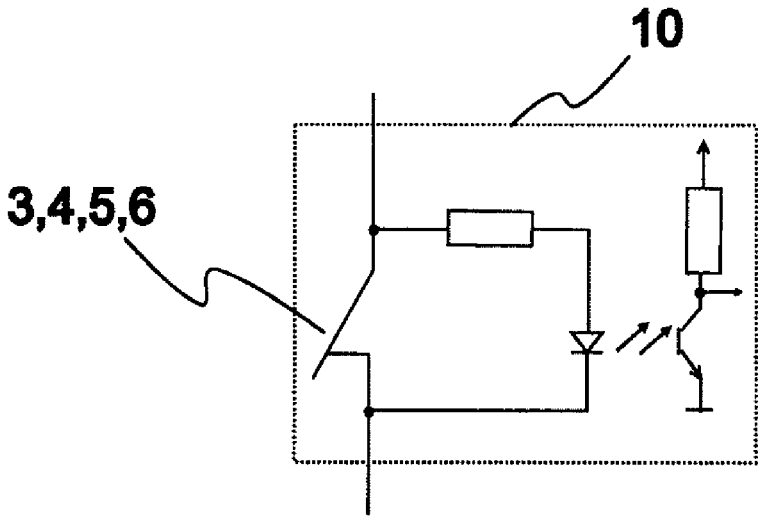
Figure 3:
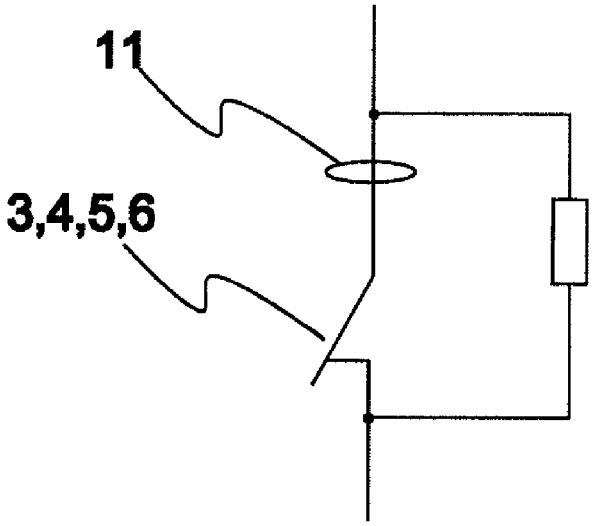
Figure 4:
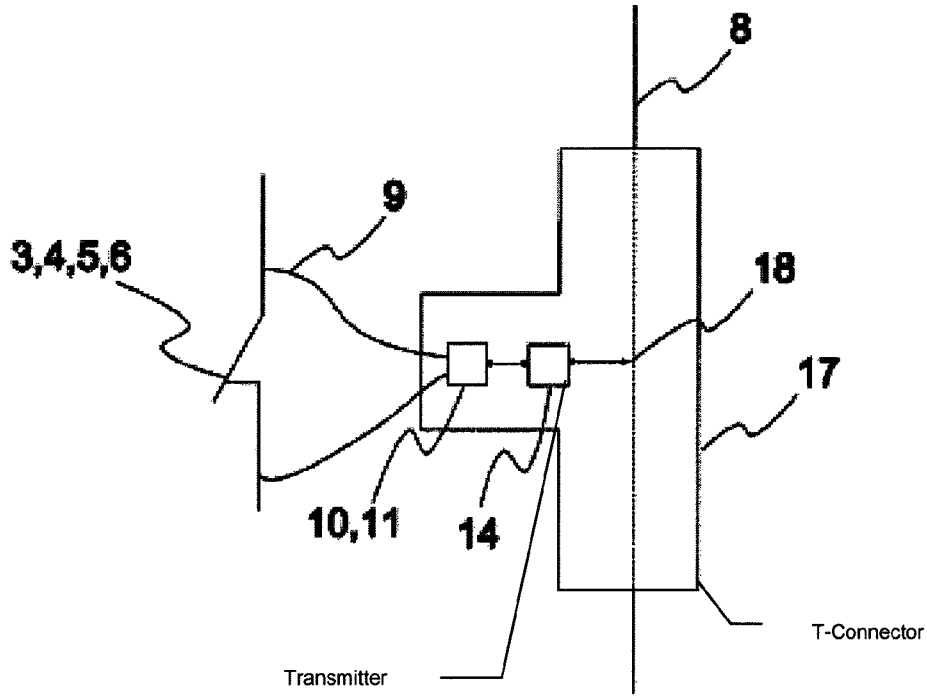
Figure 5:
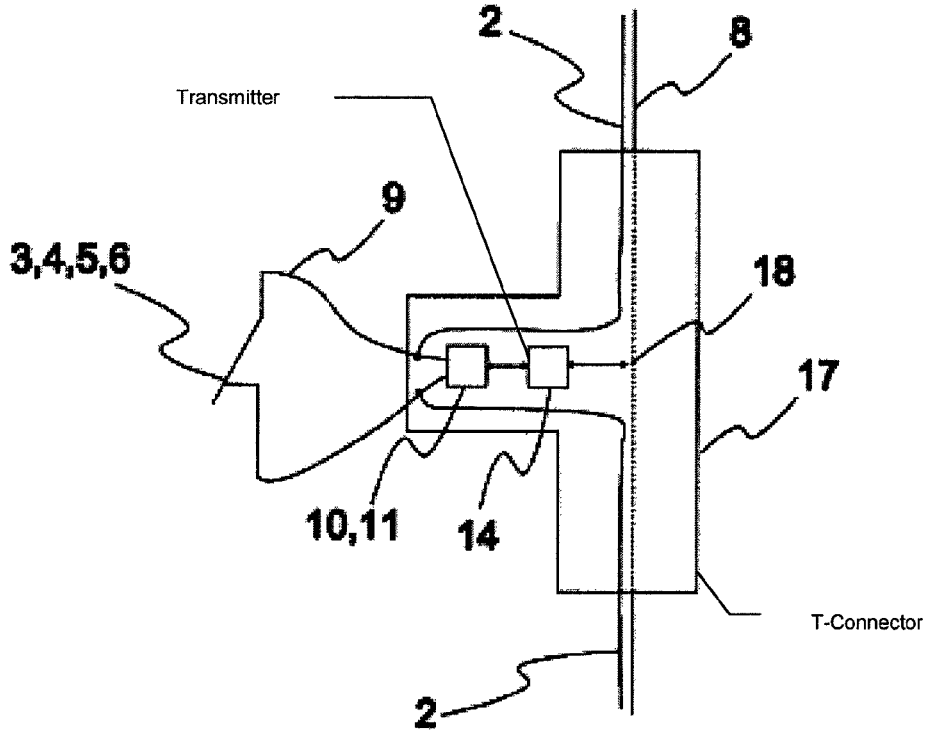
Figure 6:
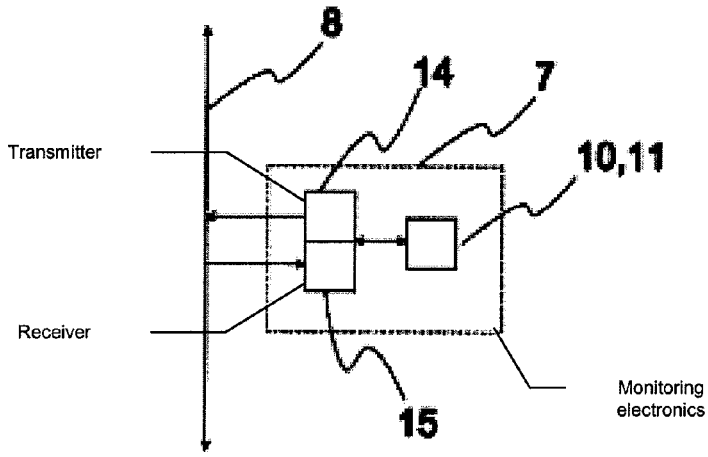
Figure 7:
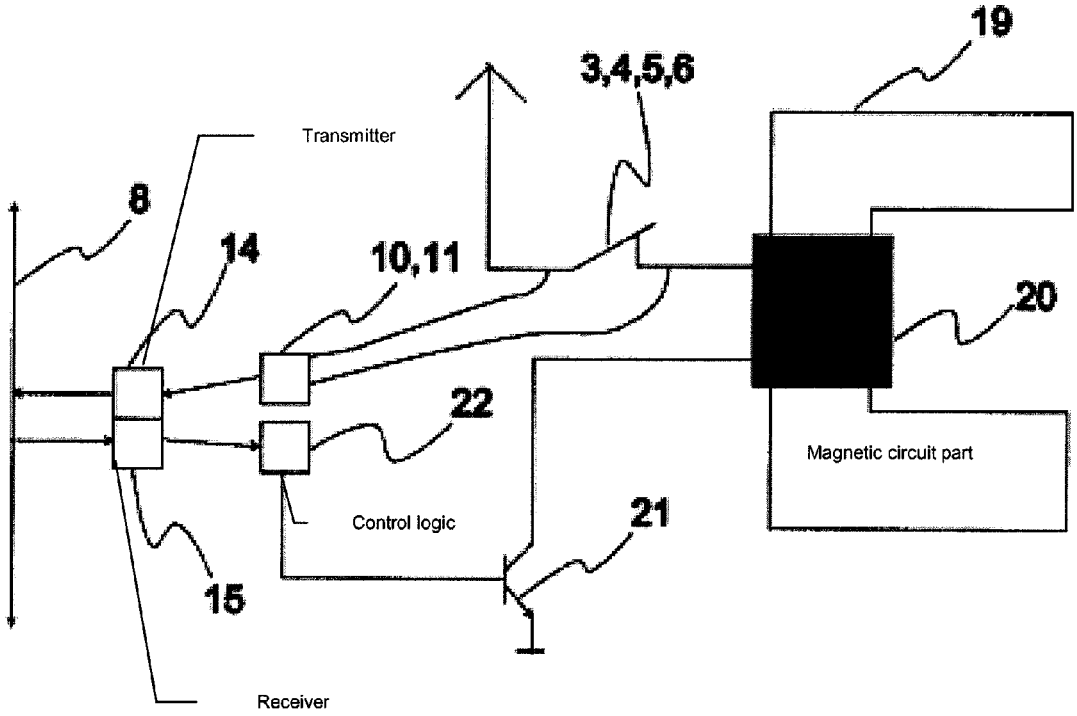
Figure 8:
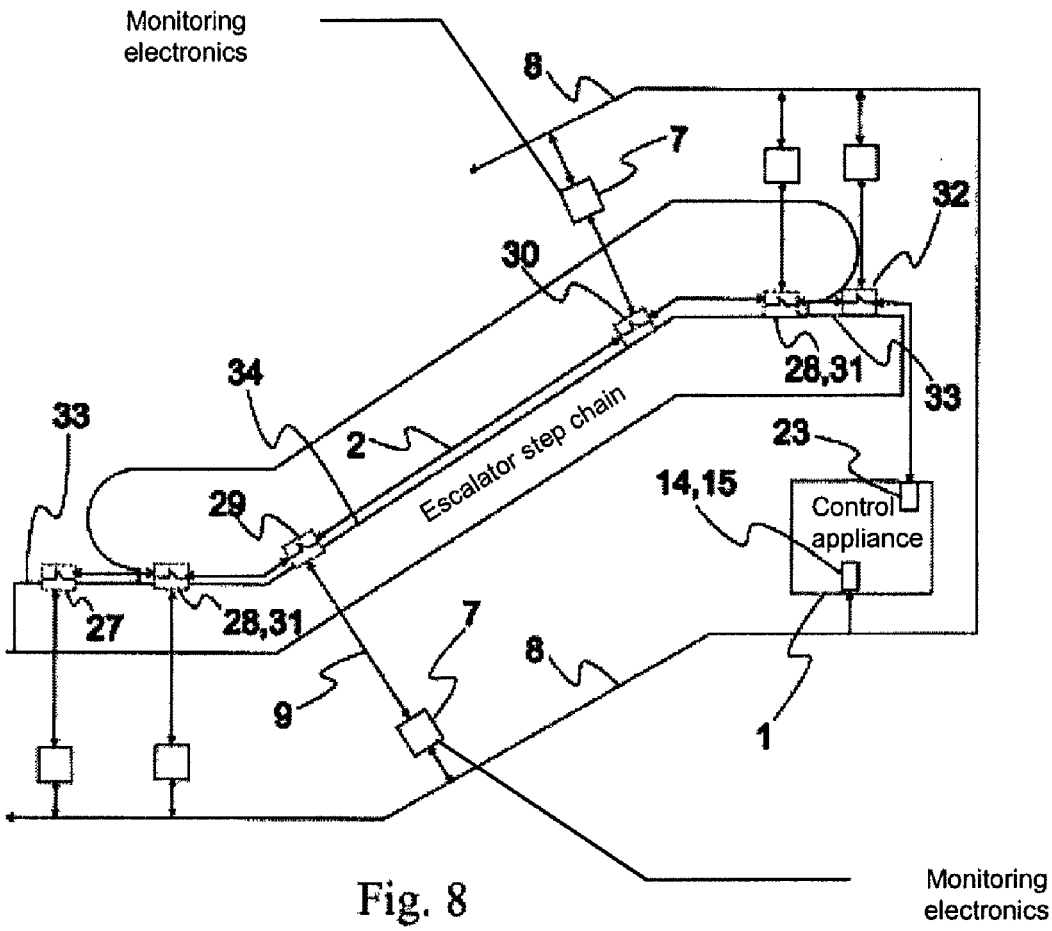

In the following, the invention will be described in more detail by the aid of a few examples of its embodiments with reference to the attached drawings, wherein FIG. 1 presents one arrangement according to the invention for monitoring the safety circuit of an elevator system FIG. 2 presents the means incorporated in one arrangement according to the invention for measuring the voltage between the contacts of the switch FIG. 3 presents the means incorporated in one arrangement according to the invention for measuring the current traveling in a switch FIG. 4 presents a first T-connector fitted into an arrangement according to the invention FIG. 5 presents a second T-connector fitted into an arrangement according to the invention FIG. 6 presents monitoring electronics fitted in connection with a switch FIG. 7 presents an actuator connected to an arrangement according to the invention FIG. 8 presents an arrangement according to the invention for monitoring the safety circuit of an escalator system

DETAILED DESCRIPTION OF THE INVENTION

FIG. 1 presents an elevator system, in which the arrangement according to the invention is applied. In the elevator system according to FIG. 1 the power supply of the elevator motor occurs via the power supply circuit 24. At least one stopping appliance of the elevator car is controlled with a brake control circuit (13). The switches 3, 4, 5, 6 are disposed in points that are important from the standpoint of the safety of the elevator system. The switches 3, 4 are disposed in connection with the landing doors and the switches 5, 6 in connection with the end limits of the elevator. The brake control circuit 13 contains an input 26 for the serial circuit 2 of switches, as also the power supply circuit 24 of the motor contains an input 25 for the serial circuit of switches. When at least one of the switches of the serial connection circuit opens, the power control circuit of the motor and also the brake control circuit are disconnected, in which case the power supply to both the motor and to the brake are disconnected and the elevator system switches to drive prevented mode. The arrangement according to the invention comprises means 10, 11 for measuring the status of a switch as well as a transmitter 14 in connection with these means, with which the status information of the switch is sent to the data transfer channel 8. The control appliance 1 contains a receiver 15 connected to the data transfer channel, and the control appliance reads the status of the switches by means of this, in which case the status of an individual switch of the serial connection circuit 2 can be identified. In addition, the control appliance can contain an input for the serial circuit 2 of switches as well as means 23 for measuring the status of the serial circuit of switches. In this case the control appliance can compare with each other at least the measured status data of the switches 3, 4, 5, 6 to the status information of the serial connection circuit separately measured with the means 23 and on the basis of the comparison can deduce the operating condition of the measurements of the serial connection circuit. If, for example, the status data of the switches read with the receiver 15 of the control appliance differ from the status data of the serial connection circuit 2 measured with the means 23, it can be inferred that there is an error in at least one measurement. In this case the control appliance 1 prevents the next run with the elevator.

In a second arrangement according to the invention the serial connection circuit is not wired separately to the brake control circuit or to the power supply circuit, but only to the control appliance 1. In this case the control appliance 1 only reads the status of the serial connection circuit 2 with the means 23. In addition to this, the control appliance 1 reads the status of the individual switches 3, 4, 5, 6 of the serial connection circuit 2 from the data transfer channel 8 with the receiver 15. If the control appliance detects that the safety of the elevator system is jeopardized, such as the switch 3,4 of a landing door being open or an end limit switch 5, 6 that has opened, the control appliance 1 prevents the next run by controlling open at least the brake control circuit 13 and possibly also the power supply circuit 24. In addition to this the control appliance 1 compares the status of the serial connection circuit measured with the means 23 to the status data of the individual switches read with the receiver 15 and when it detects that these differ from each other it infers that at least one measurement (10, 11, 23) of the switches is defective. Also in this case the control appliance 1 prevents the next run. The control appliance 1 can also send defect information to the servicing center both when it detects that the safety of the elevator system is jeopardized and when it detects that a measurement is defective. Since the control appliance reads the operating status of individual switches it is possible to send to the servicing center information about which point important from the standpoint of the safety of the elevator system a malfunction occurs. This improves the diagnostics of the elevator system.

The means 23 for measuring the status of the serial connection circuit 2 of switches can comprise a voltage source, with which voltage is supplied to the serial connection circuit, as well as means for measuring the voltage from some other point of the serial connection circuit. The voltage measured depends on whether there are open switches in the serial connection circuit between the input point of the voltage and the measuring point.

FIG. 2 presents means incorporated in one arrangement according to the invention 10 for measuring the voltage between the contacts of a switch. The arrangement in this embodiment of the invention comprises a prior-art AC or DC voltage source, with which the serial connection circuit is supplied. If the switch opens, the voltage between the contacts of the switch grows. This voltage is measured by connecting a resistor in parallel with the switch in series with the primary side of the opto-isolator. As the voltage between the contacts of the switch grows, the current on the primary side, and thus also on the secondary side, of the opto-isolator grows, and this current is measured from the secondary side e.g. with a measuring resistor.

FIG. 3 presents means incorporated in one arrangement according to the invention 11 for measuring the current traveling through a switch. In this embodiment of the invention the arrangement comprises some prior-art AC or DC voltage source. The current is measured with some prior-art appliance 1, such as with a series resistor or with a Hall sensor. When the switch 3, 4, 5, 6 opens, the passage of current in the switch ceases. In order for the opened switch to be identified, the passage of current in the other switches of the serial connection circuit must continue. Owing to this, a current path, such as resistor, according to FIG. 3 must be added in parallel with at least the open switch.

FIG. 4 presents a T-connector 17 fitted into an arrangement according to the invention. The means 10, 11 for measuring the status of a switch are fitted inside the T-connector, as is also the transmitter 14. The data transfer channel 8 is in the main branch of the T-connector. By means of the connector control electronics 7 for measuring the status of the switch 3, 4, 5, 6 is connected to the data transfer channel 8. Measuring conductors 9 are on the poles of the switch, which are taken inside the T-connector to the means 10, 11 for measuring the status of the switch. The measured status information is sent to the data transfer channel 8 with the transmitter 14, which is connected to the data transfer channel in the connection point 18 inside the T-connector. The T-connector can be manufactured to be waterproof, in which case the electrical connection points are protected from dampness and the reliability of the electrical system of the elevator improves.

FIG. 5 presents a second T-connector 17 fitted into an arrangement according to the invention. The wiring of the T-connector varies from that of FIG. 4 in that both the conductor of the data transfer channel 8 and the conductor of the serial circuit 2 of switches run in the main branch of the T-connector, and the measuring conductors 9 are in series with the serial circuit 2 of switches. An advantage of this embodiment of the invention is that the conductors of both the serial circuit 2 and of the data transfer channel 8 can be led in the same wiring bundle from the main branch of the T-connector to the connector, in which case the wiring in connection with the T-connector is simplified.

FIG. 6 presents monitoring electronics 7 according to one embodiment of the invention fitted in connection with a switch. The monitoring electronics can comprise means 10, 11 for measuring the status information of the switch, a transmitter 14, and a receiver 15 for receiving control commands from the data transfer channel 8. Correspondingly, the control appliance 1 can contain a transmitter for sending control commands to the data transfer channel. Control commands can be used e.g. to control an actuator fitted to the arrangement according to the invention.

FIG. 7 presents an actuator, with its control electronics, connected to an arrangement according to the invention. In this embodiment of the invention the actuator is a guide rail brake. FIG. 6 presents a part of the magnetic circuit 19 of the guide rail brake. The magnetic circuit is magnetized by supplying current to the magnetizing coil 20, and when current flows the guide rail brake is open. In this case the elevator can move freely along the guide rail. When the current flowing in the coil 20 disconnects, the guide rail brake grips hold of the guide rail and movement of the elevator car is prevented. In this embodiment of the invention the serial circuit of the switches 3, 4, 5, 6 is in the circuit of the magnetizing coil 20. Disconnection of any switch causes disconnection of the circuit of the magnetizing coil. The status of at least one switch 3, 4, 5, 6 in the circuit of the magnetizing coil 20 is measured with the measuring means 10, 11. The status information is sent to the data transfer channel 8 with the transmitter 14. In addition, the arrangement contains a receiver 15, with which the control commands of the guide rail brake are received from the data transfer channel 8. The control commands are taken to the control logic 22, which in turn controls the current of the magnetizing coil 20 with the switch 21. In this arrangement according to the invention it is possible to test the condition of the control and monitoring appliance by sending a testing signal to the data transfer channel 8 with the control appliance 1, with which the switch 21 is controlled on. The status of at least one switch 3, 4, 5, 6 in the circuit of the magnetizing coil 20 is measured with the measuring means 10, 11 and the status information is sent to the data transfer channel, from where it is read with the control appliance 1. After this a new testing signal is sent with the control appliance 1, with which the switch 21 is controlled off, the change in the status of the switch 3, 4, 5, 6 is read from the data transfer channel and thus the condition of the control and monitoring appliance is deduced.

FIG. 8 presents how one arrangement according to the invention for monitoring a safety circuit is applied in an escalator system. The figure presents only some of the points important from the standpoint of the safety of the escalator system and some of the safety switches disposed in these points.

At the upper exit and the lower exit of an escalator system are comb plates (33), which are intermeshed with the step chain (34), closing the point of bending that occurs in the change of direction of the step belt. A step chain means a combination of steps and a fixing chain connecting them. The comb plate contains safety switches (27, 32) which open if the comb plate for some reason moves along with the step chain. Moving can result e.g. if a passenger or an object has become entangled in the step chain. In addition, key start switches as well as manually-operated emergency stop switches 28, 31 are in connection with the bottom exit and/or the top exit. In addition, in this embodiment of the invention the step chain contains a step-break detector 29 as well as a missing-step detector 30. The serial circuit 2 of switches is taken to the control appliance 1, which contains means 23 for measuring the status of the serial circuit. The serial circuit can be in the brake control circuit 13 as well as in the power supply circuit 24 of the escalator motor, which are not presented in this figure. When a switch opens the brake control circuit and the power supply circuit open, in which case the step chain stops. Control electronics 7, which reads the status of an individual switch and sends the status information to the data transfer channel 8, is in connection with the switches. The control appliance 1 contains a receiver 15, by means of which the control appliance reads the status data of the switches, is connected to the data transfer channel. On the basis of the status information of the switches the control appliance identifies in which part of the escalator system the defect has occurred. Information about the defect as well as information about the location of the defect can be sent to the servicing center. By comparing the status information of the serial circuit of switches and the status data of individual switches it is also possible to deduce the operating condition of the measurements.

In one arrangement according to the invention both the power supply circuit 24 and the brake control circuit 13 are opened with a controllable switch, the control of which comes from the control appliance 1. In this embodiment of the invention the switches are not directly in the brake control circuit or in the power supply circuit, in which case a short-term break of the serial circuit similar in nature to a malfunction does not cause a break in the brake control circuit or in the power supply circuit, and the step chain does not stop unnecessarily as a consequence of malfunctions. Since the control appliance reads the status information of the switches separately as status information of the serial circuit and as status information of the individual switches, adequate reliability of operation is achieved with duplicated measurement. Additionally, the controllable switch in this arrangement according to the invention must be reliable. Reliability can be increased according to prior art e.g. by duplicating the switch element and the control electronics of the switch.

The invention is not limited solely to the embodiments described above, but instead different variations are possible within the scope of the inventive concept defined by the claims below.

REFERENCES OF THE FIGURES

| | |
|---|---|
| 1 | control appliance |
| 2 | serial circuit of switches |
| 3 | door switch |

-continued

| REFERENCES OF THE FIGURES | |
|---|---|
| 4 | door switch |
| 5 | top end limit switch |
| 6 | bottom end limit switch |
| 7 | monitoring electronics of switch |
| 8 | data transfer channel |
| 9 | switch state measuring wires |
| 10 | means for measuring voltage between the contacts of the switch |
| 11 | means for measuring current flowing in the switch |
| 13 | brake control circuit |
| 14 | transmitter |
| 15 | receiver |
| 17 | T-connector |
| 18 | connection point |
| 19 | part of magnetic circuit of guide rail brake |
| 20 | magnetic coil |
| 21 | control switch of guide rail brake |
| 22 | control logic |
| 23 | means for measuring the state of the serial circuit of switches |
| 24 | power-supply-circuit of the motor |
| 25 | input of serial circuit of switches in the power input circuit |
| 26 | input of serial circuit of switches in the brake control circuit |
| 27 | switch of comb plate of bottom exit of escalator |
| 28 | key start switch |
| 29 | step-break detector |
| 30 | missing-step detector |
| 31 | manually-operated emergency stop switch |
| 32 | switch of comb plate of top exit of escalator |
| 33 | comb plate |
| 34 | step chain of escalator |

The invention claimed is:

1. Arrangement for monitoring a safety circuit in a transport system, in which the arrangement comprises:

a motor power supply circuit;

a brake control circuit;

a control appliance;

a first measuring unit for measuring the status of at least one individual switch; and an information conveying unit for conveying the measured status information of the measured switch to the control appliance;

wherein the safety circuit includes at least one serial circuit of two or more safety switches disposed in pre-determined safety points within the transport system;

wherein at least one serial circuit of switches is fitted in connection with at least one of the brake control circuit and the motor power supply circuit such that said at least one of the brake control circuit and the motor power supply circuit are controlled based on the status of the switch; and wherein the information conveying unit includes a transmitter in connection with said switch, a receiver in connection with said control appliance, and a data transfer channel between said transmitter and said receiver.

2. Arrangement according to claim 1, wherein the arrangement comprises a second measuring unit for measuring the status of the serial circuit of switches.

3. Arrangement according to claim 1, wherein the first measuring unit includes a voltage measuring unit for measuring the voltage between the contacts of a switch; and where said voltage measuring unit is fitted in connection with said switch.

4. Arrangement according to claim 1, wherein the first measuring unit includes a current measuring unit for measuring the current traveling in a switch; and where said current measuring unit is fitted in connection with the switch.

5. Arrangement according to claim 2, wherein the second measuring unit is in the control appliance.

6. Arrangement according to claim 1, wherein the arrangement further comprises a T-connector, and the first measuring unit and the transmitter are fitted inside the T-connector.

7. Arrangement according to claim 1, wherein the safety circuit contains at least one actuator, and the transmitter is in connection with the actuator.

8. Arrangement according to claim 7, wherein the receiver is in connection with the actuator.

9. Arrangement according to claim 7, wherein the transmitter is fitted to send status information to the control appliance as a serial interface message.

10. Arrangement according to claim 1, wherein the control appliance includes a receiver.

11. Method for monitoring a safety circuit, in which the safety circuit comprises a serial circuit of two or more switches, the method comprising:

measuring the status of at least one individual switch with a measuring unit;

conveying the measured status information of the switch to a control appliance providing the at least one serial circuit of switches fitted in connection with at least one of a brake control circuit and a motor power supply circuit; and controlling at least one of the brake control circuit and the motor power supply circuit based on the measured status information of the switch.

12. Method according to claim 11, wherein the method further comprises the phase:

measuring the status of a said at least one serial circuit of switches.

13. Method according to claim 11 wherein said conveying is performed with a transmitter;

said transmitter and said measuring unit are fitted inside a T-connector; and the transmitter is connected to a data transfer channel such that the connection of the transmitter and the data transfer channel occurs inside the T-connector.

14. Arrangement according to claim 2, wherein a voltage measuring unit for measuring the voltage between the contacts of a switch is provided in connection with the switch.

15. Arrangement according to claim 2, wherein a current measuring unit for measuring the current traveling in a switch is provided in connection with the switch.

16. Arrangement according to claim 3, wherein a current measuring unit for measuring the current traveling in a switch is provided in connection with the switch.

17. Arrangement according to claim 2, wherein the second measuring unit is provided in the control appliance.

18. Arrangement according to claim 3, wherein a second measuring unit for measuring the status of the serial circuit of switches is provided in the control appliance.

19. Arrangement according to claim 4, wherein a second measuring unit for measuring the status of the serial circuit of switches is provided in the control appliance.

* * * * *